US006285134B1

(12) United States Patent
Yano et al.

(10) Patent No.: US 6,285,134 B1
(45) Date of Patent: Sep. 4, 2001

(54) LIGHT IRRADIATION METHOD FOR VARYING A PERCEIVED BRIGHTNESS

(75) Inventors: Tadashi Yano, Kyoto; Yukio Akashi, Osaka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/411,117

(22) Filed: Oct. 4, 1999

(30) Foreign Application Priority Data

Oct. 5, 1998 (JP) ..... 10-282439

(51) Int. Cl.[7] ..... H05B 37/00

(52) U.S. Cl. ..... 315/149; 315/158; 315/159; 315/DIG. 4

(58) Field of Search ..... 362/235; 315/149, 315/159, 158, DIG. 4; 250/214 AL

(56) References Cited

U.S. PATENT DOCUMENTS

| | | | | |
|---|---|---|---|---|
| 4,063,807 | | 12/1977 | Gelius et al. . | |
| 4,882,661 | | 11/1989 | Arnaud | 362/242 |
| 4,963,798 | | 10/1990 | McDermott | 315/312 |
| 5,015,924 | | 5/1991 | Berman et al. . | |
| 5,250,799 | * | 10/1993 | Werner | 250/214 AL |
| 5,285,060 | * | 2/1994 | Larson et al. | 250/214 AL |

FOREIGN PATENT DOCUMENTS

| | | |
|---|---|---|
| 0 377 386 | 7/1990 | (EP) . |
| 0 699 863 | 3/1996 | (EP) . |
| 0 896 361 | 2/1999 | (EP) . |
| 2-253503 | 10/1990 | (JP) . |
| 7-14680 | 1/1995 | (JP) . |
| 10-12010 | 1/1998 | (JP) . |

OTHER PUBLICATIONS

Tiller et al., "Perceived Room Brightness: Pilot Study on the Effect of Luminance Distribution," 1995, vol. 27, No. 2.
Roufs et al., "Global Brightness Contrast and the Effect on Perceptual Image Quality," 1994, vol. 2179.
European Search Report, application No. 99119142, dated Oct. 26, 2000.

* cited by examiner

*Primary Examiner*—David Vu
(74) *Attorney, Agent, or Firm*—Ratner & Prestia

(57) ABSTRACT

In a light irradiation method, a main irradiation section forming a target and a sub irradiation section for providing sub illumination light to or from at least one of a background and a neighborhood of the target are provided, and a perceived brightness of the target is varied by performing time-wise control of an intensity of the sub illumination light emitted by the sub irradiation section. When applied to an illumination system wherein the main irradiation section is an illumination source, or to an indication system wherein the main irradiation section is an indication lamp, a perceived brightness of the illumination source or the indication lamp is decreased by increasing the intensity of the sub illumination light, while increased by decreasing the intensity of the sub illumination light. When applied to an image display system wherein the main irradiation section is an image display section for displaying a prescribed image, a perceived brightness of the prescribed image is increased by increasing the intensity of the sub illumination light, while decreased by decreasing the intensity of the sub illumination light.

15 Claims, 5 Drawing Sheets

LIGHT IRRADIATION METHOD FOR VARYING A PERCEIVED BRIGHTNESS

BACKGROUND OF THE INVENTION

1. Field of the Invention

The present invention relates to a light irradiation method and a light irradiation system for increasing or decreasing a perceived brightness of a target, which is illuminated, by performing time-wise control of prescribed illumination light.

2. Description of the Related Art

Various illumination methods for increasing a brightness perceived regarding an illuminated target (hereinafter, referred to as, for example, a "perceived brightness of a target") have been studied. From a practical point of view, the entirety of the inside of a room is set as a target, and researches on methods for increasing the perceived brightness of a target are performed.

According to one of the methods developed so far, walls of the room are illuminated to be brighter than the rest of the room, instead of uniformly illuminating the entirety of the inside of the room. Thus, the entirety of the inside of the room is perceived to be brighter at an equal energy consumption. According to another method developed so far, a painting on the wall or a table in the room is spot-illuminated. Thus, the inside of the room is perceived to be brighter. Furthermore, according to the method recently proposed in Japanese Laid-Open Publication No. 8-279306, a "sparkling" light emitting section which is small in size but has a high luminance is included in an illumination device, so that the inside of the room is perceived to be brighter.

Regarding a target located indoors, for example, K. Hashimoto et al., "Visual Clarity and Feeling of Contrast", Color Res. Appl., Vol. 19-3, pp. 171–185 (1994) and K. Hashimbto et al., "Method for evaluating the color rendering property of a light source based on the consciousness", the Journal of the Illuminating Engineering Institute of Japan, Vol. 79, No. 11, pp. 29–37 (1995) describe that a perceived brightness of an indoor target can be raised by utilizing the phenomenon that the colorfulness of a target is increased when illuminated with a lamp having a superior color rendering property.

In a recent study performed by Ikeda et al., information obtained from various objects seen by an observer when he/she enters the room is referred to as "initial visual information", and illumination states of the inside of the room recognized based on the initial visual information including the brightness of the room is referred to as"illumination recognition visual space". Ikeda et al. has studied physical factors which determine the initial visual information and the illumination recognition visual space. As a result, it is reported that when two rooms which are different only in the brightness (reflectance) of the walls are located side by side and illuminated under the same conditions, the tone of gray color is perceived to be brighter in the room having a brighter wall (having a wall of a higher reflectance) than in the other room (Mizogami et al., "Apparent brightness based on the concept of the illumination recognition visual space", the Proceedings of the 31st (1998) Annual Conference of the Illuminating Engineering Institute of Japan, 136, page 227 (1998)).

The above-mentioned studies indicate that a perceived brightness of the target can be increased under various conditions without increasing the amount of light directly illuminating the target.

However, the above-mentioned conventional methods are all for increasing a perceived brightness of a target.

Conventionally, no method for effectively decreasing a perceived brightness of a target by performing time-wise control of light intensity without changing the amount of light directly illuminating the target has been utilized. For this reason, the conventional art has not succeeded in effectively changing (increasing and decreasing) a perceived brightness of a target.

SUMMARY OF THE INVENTION

In accordance with a light irradiation method of the present invention, a main irradiation section forming a target and a sub irradiation section for providing sub illumination light to or from at least one of a background and a neighborhood of the target are provided, and a perceived brightness of the target is varied by performing time-wise control of an intensity of the sub illumination light emitted by the sub irradiation section.

In one embodiment, the main irradiation section is an illumination source for emitting main illumination light.

Specifically, a perceived brightness of the illumination source is decreased by increasing the intensity of the sub illumination light emitted by the sub irradiation section, and a perceived brightness of the illumination source is increased by decreasing the intensity of the sub illumination light emitted by the sub irradiation section.

The time-wise control of the intensity of the sub illumination light may be performed so that a rate of change of the intensity is lower while the intensity is increasing than while the intensity is decreasing.

In one embodiment, the main irradiation section is an indication lamp for emitting a prescribed indication light.

Specifically, a perceived brightness of the indication lamp is decreased by increasing the intensity of the sub illumination light emitted by the sub irradiation section, and a perceived brightness of the indication lamp is increased by decreasing the intensity of the sub illumination light emitted by the sub irradiation section.

The time-wise control of the intensity of the sub illumination light may be performed so that a rate of change of the intensity is lower while the intensity is increasing than while the intensity is decreasing.

In one embodiment, the main irradiation section is an image display section for displaying a prescribed image, and the target is the prescribed image.

Specifically, a perceived brightness of the prescribed image is increased by increasing the intensity of the sub illumination light emitted by the sub irradiation section, and a perceived brightness of the prescribed image is decreased by decreasing the intensity of the sub illumination light emitted by the sub irradiation section.

Preferably, the prescribed image includes a content, a brightness of which is inherently changeable.

Preferably, a highest luminance of the sub illumination light is set to be equal to or less than a highest luminance of the target.

The intensity of the sub illumination light may be increased and decreased repeatedly.

The intensity of the sub illumination light may be varied in accordance with a sine waveform having a frequency of about 0.01 Hz or more and about 8 Hz or less.

Preferably, a minimum value of the intensity of the sub illumination light is larger than zero.

Preferably, the sub irradiation section is located at such a position that prevents an observer from viewing the sub irradiation section.

Thus, the invention described herein makes possible the advantages of providing an illumination method for effectively changing (increasing and decreasing) a perceived brightness of a target by changing illumination conditions of the background or the neighborhood of the target without changing the amount of light directly illuminating the target.

These and other advantages of the present invention will become apparent to those skilled in the art upon reading and understanding the following detailed description with reference to the accompanying figures.

DESCRIPTION OF THE PREFERRED EMBODIMENTS

Generally, a perceived brightness of a target is influenced by a contrast thereof relative to the brightness of the background or neighborhood thereof. The present inventors studied the relationship between the illumination conditions in the background or neighborhood of the target and the perceived brightness of the target from various aspects. As a result, the present inventors confirmed that the perceived brightness of the target can be effectively changed (increased or decreased) by performing time-wise control of the illumination conditions in the background or neighborhood of the target, more specifically, an intensity of at least one of light illuminating the background or neighborhood of the target and light provided from the background or neighborhood of the target, without changing the amount of light directly illuminating the target.

Hereinafter, the present invention made based on the above-described study results performed by the present inventors will be described by way of illustrative examples with reference to the accompanying drawings.

EXAMPLE 1

In a first example of the present invention, a light irradiation method (simply referred to as the "irradiation method" hereinbelow) according to the present invention is applied to an image display system.

Figure 1:
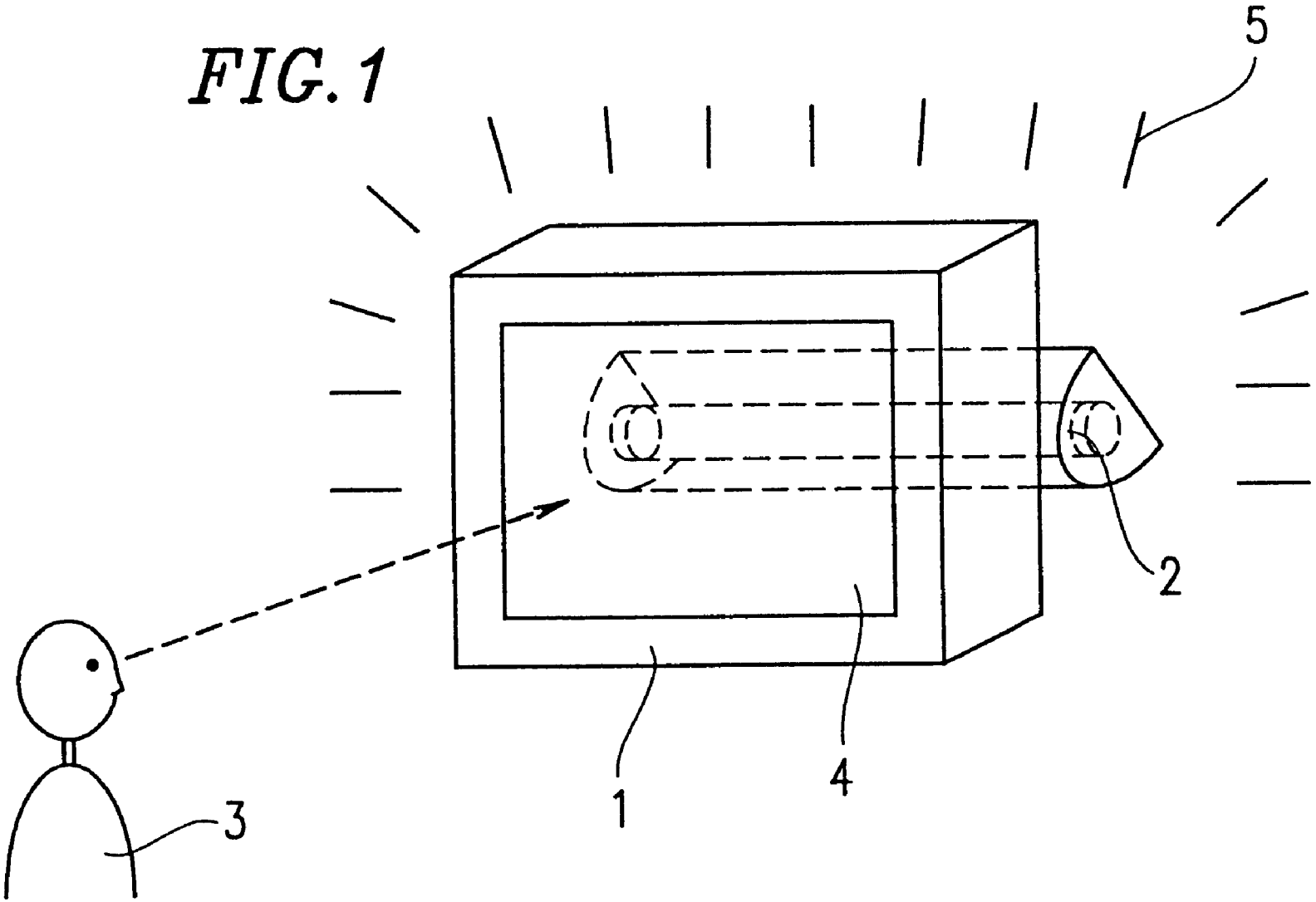
FIG. 1 is a schematic isometric view of an image display system to which a light irradiation method according to the present invention is applied, as a first example of the present invention.

FIG. 1 is a schematic isometric view illustrating a structure of an image display system to which an irradiation method according to the present invention is applied. The image display system includes an image display device 1 and an illumination source 2 located behind the image display device 1. On a display section of the image display device 1, an image 4 is displayed. The background and the neighborhood of image display device 1 are illuminated with illumination light 5 directed from the illumination source 2. The image display device 1 can be, for example, a CRT, and the illumination source 2 for emitting the illumination light 5 can be, for example, a straight type 40W fluorescent lamp.

Figure 2:
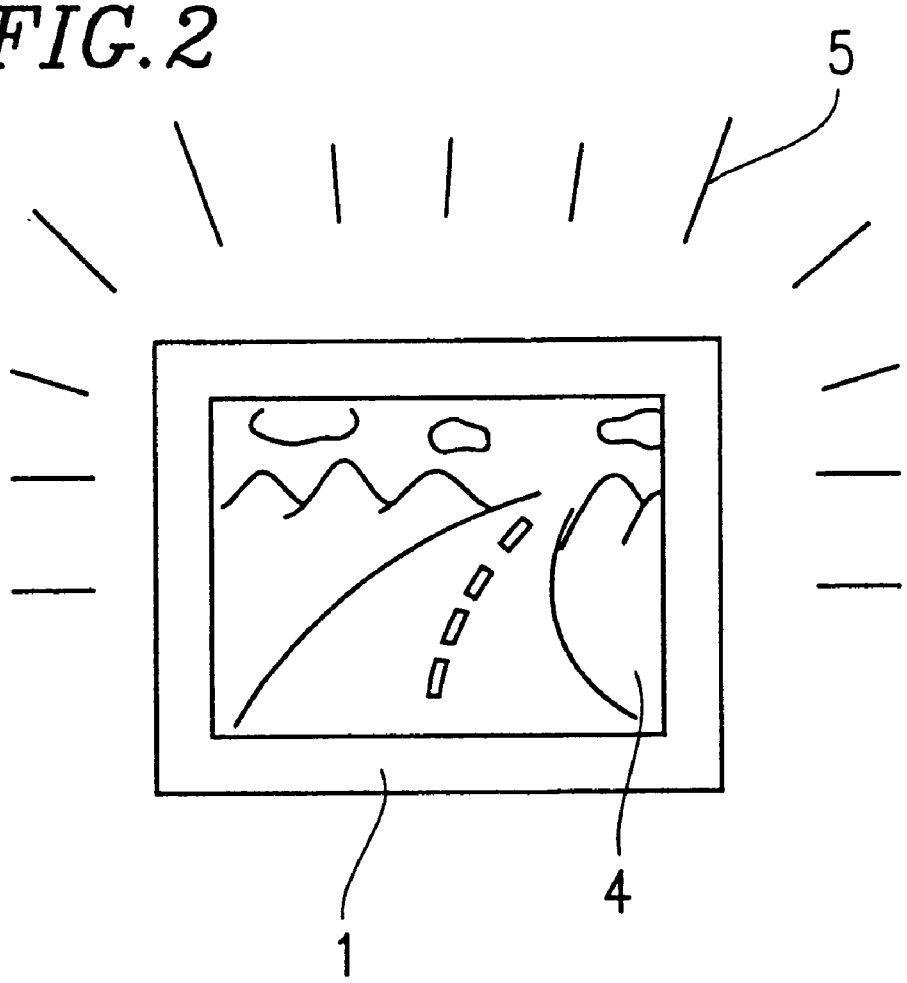
FIG. 2 is a schematic view of the image display system shown in FIG. 1 viewed from an observer positioned right in front of the image display system.

FIG. 2 is a schematic view showing such an image display system viewed by an observer 3 (FIG. 1) positioned directly in front of the image display device 1. As shown in FIG. 2, the observer 3 observes the image display device 1, the image 4 displayed on the display section of the image display device 1, and the illumination light 5 in the background and the neighborhood of the image display device 1 emitted by the illumination source 2 located behind the image display device 1. In the state of FIG. 2, the observer 3 can not see the illumination source 2.

According to an irradiation method of the present invention, the image display device 1 is considered to be a main irradiation section, and the illumination source 2 for emitting the illumination light 5 to illuminate the background and the neighborhood of the image display device 1 is considered to be a sub irradiation section. A perceived brightness of the image 4 (i.e., target) displayed by the image display device 1 (i.e., the main irradiation section) is varied by performing time-wise control of an intensity of the illumination light 5 emitted by the illumination source 2 (i.e., sub irradiation section). The mechanism of varying the perceived brightness in this manner is based on the following phenomenon which has been confirmed by the present inventors as a result of their studies.

In the state where a highest luminance of the inside of the image 4 (i.e., the luminance of the brightest pixel among a plurality of pixels forming the image 4) is substantially equal or higher than a highest luminance of the illumination light 5 (also referred to as "sub illumination light"), when the intensity of the illumination light 5 is increased or decreased, preferably in the range not exceeding the highest luminance of the image 4, the observer 3 perceives that the illumination in the background and the neighborhood of the image display device 1 obtained by the illumination light 5 is integrated with the illumination obtained from a content of the image 4. Accordingly, when the intensity of the illumination light 5 is increased, the perceived brightness of the image 4 as the target is increased; and when the intensity of the illumination light 5 is decreased, the perceived brightness of the image 4 is decreased.

In order to fulfill the conditions that "in the state where the highest luminance of the inside of the image 4 is substantially equal or higher than the highest luminance of the illumination light 5, the intensity of the illumination light 5 is increased or decreased in the range not exceeding the highest luminance of the image 4", the illumination light 5 is increased or decreased so that the highest luminance thereof is about 80% or more and 100% or less of the highest luminance of the image 4. The value "80%" is based on the following report by Ikeda et al. on a series of experiments: In order to cause an observer of two rooms illuminated under different conditions located side by side to perceive continuity between the two rooms, the illuminance of one of the rooms needs to be set at 0.8 to 1.5 times the illuminance of the other room. (See, for example, I et al., "Tolerable range of illuminance and color which provides perceived continuity between two room", the Journal of the Illuminating Engineering Institute of Japan, Vol. 82, No. 8A, pp. 523–529 (1998)).

The upper limit of "100% of the highest luminance of the image 4" regarding the intensity of the illumination light 5 is an optimum value for providing an effect in this example. In consideration of the value of "1.5 times"reported by I et al., the observer 3 can perceive that the illumination in the background and the neighborhood of the image display device 1 obtained by the illumination light is integrated with the illumination obtained from a content of the image 4, and thus, the effect of this example can be provided so long as the highest luminance of the illumination light 5 is about 150% or less of the highest luminance of the image 4. The lower limit of "80% of the highest luminance of the image 4" also regarding the intensity of the illumination light 5 is an optimum value for providing the effect in this example. The highest luminance of the illumination light 5 can be lower than the above-mentioned lower limit so long as the observer can perceive a change (i.e., fluctuation) in the illumination.

Under the above-described illumination conditions, the observer 3 perceives that the illumination light 5 in an illumination environment in which the image 4 is observed is integrated with an illumination environment obtained from the unreal image 4 displayed by the image display device 1. Accordingly, the observer 3 perceives a change in the brightness of the image 4 and also feels more strongly the sense of being at the site of the image 4.

As described above, an image display system to which an irradiation method according to the present invention is applied includes (1) an image display device, as a main irradiation section, for displaying an image as a target and (2) an illumination source, as a sub irradiation section, for providing a background or neighborhood of the target with the illumination light (the sub illumination light). By performing time-wise control of the intensity of the illumination light (the sub illumination light) emitted by the illumination source (the sub irradiation section), a perceived brightness of the target (more specifically, a part of the image which appears to reflect or direct light outside such as, for example, sky or beach in the daytime) is varied. This is realized because the illumination environment of the background or neighborhood of the target provided by the sub illumination light is perceived by the observer to be integrated with the illumination environment obtained by the content of the image 4; i.e., a mistaken perception is induced. A perceived brightness of the target can be increased by increasing the intensity of the illumination light emitted by the sub irradiation section, and the perceived brightness of the target can be decreased by decreasing the intensity of the illumination light emitted by the sub irradiation section. By thus changing (increasing or decreasing) the perceived brightness of the target, the observer is caused to more strongly feel the sense of being at the site of the image.

The image display device 1 as the main irradiation section may be any display device operating based on any display principle. The image display device 1 may be a PDP (plasma display panel), an LCD (liquid crystal display), a projector or any other display device instead of the CRT (cathode ray tube). Preferably, the image display device 1 displays the image 4 at a relatively high luminance since, according to the present invention, (1) the background or neighborhood of the image 4 is illuminated by the illumination light 5 emitted by the illumination source 2 (the sub irradiation section), and (2) the range of change in the intensity of the illumination light 5 is determined by the highest luminance of the image 4.

The illumination source 2 acting as the sub irradiation section for emitting the illumination light 5 may be any light emitting device operating based on any light emitting principle so long as the intensity of the light can be adjusted. The illumination source 2 may be an incandescent lamp, an LED, an EL element or any other light emitting device.

The image 4 displayed by the image display device 1 can be classified into one of two categories of a still image and a moving image. Alternatively, the image 4 can be classified into one of two categories of an actual image and a CG image. The present inventors confirmed by experiments regarding a still actual image and a moving CG image that the perceived brightness of the image 4 can be varied (increased or decreased) and the image 4 can make the observer feel a sense of being at the site of the image 4 more strongly. Accordingly, the effect of the present invention applied to an image display system can be provided regardless of the type of the image.

From the viewpoint of ease in perceiving a change in the brightness, the above-described mistaken perception of the illumination environment is more easily induced in the case of a moving image than a still image and in the case of an actual image than a CG image. The reason for this is that a moving image and an actual image appear to be more real. Accordingly, the effect of the present invention is enhanced in the case of a still actual image than a still CG picture, and in the case of a moving CG image than a still actual image. In the case of a moving actual image, the intensity of the Illumination light 5 needs to be changed in association with the content of the image, which requires a different technology from the technology used in this example.

The content of the image 4 is an important element for providing the effect according to the present invention. As can be appreciated from FIG. 2, an image having a content which allows the observer to immediately perceive the illumination environment in the image is preferable for providing the effect of the present invention, because such an image allows the observer to perceive the Integrity of the illumination environment of the image with the illumination environment of the background or neighborhood thereof, and also allows the observer to perceive a change in the illumination environment. For the above purpose, it is preferable that the image 4 (even when it is a still image) includes such a content that a brightness thereof is inherently changeable.

More specifically, according to the present invention, the observer 3 observing an object or light in the image 4 is led to have a mistaken perception that the brightness of the object or light in the image 4 is changing when the intensity of the illumination light 5 provided to the background or neighborhood of the image 4 by the illumination source 2 (the sub irradiation section) is varied. The observer 3 cannot have the above-mentioned mistaken perception unless the object or light in the image 4 can have a brightness inherently changeable (i.e., can be brightened or darkened). Examples of the object or light fulfilling such a condition include the object or light having a fluctuation (variation) in its brightness condition, such as sky, shade of a tree, beach illuminated by sunlight, candle light, and bonfire.

The rate of change (increase or decrease) of the intensity of the illumination light 5 needs to be set so that the change is sufficiently perceivable by the observer 3 but does not cause the observer 3 to feel the light is uncomfortably flickering. Specifically, the frequency of 8 Hz or less is preferable.

The present inventors observed a change in the perceived brightness by varying the intensity of the illumination light 5 at different frequencies. A change in the perceived brightness was obtained most effectively when the intensity of the illumination light 5 was varied at about 0.2 Hz. When the intensity of the illumination light 5 was varied at about 0.01 Hz or less, the observer perceived that the change in the brightness was excessively dull, and thus the effect of a change in the perceived brightness was insufficient. As can be appreciated, the intensity of the illumination light 5 is preferably changed at a frequency in the range of about 0.01 Hz or more and about 8 Hz or less.

Figure 3A:
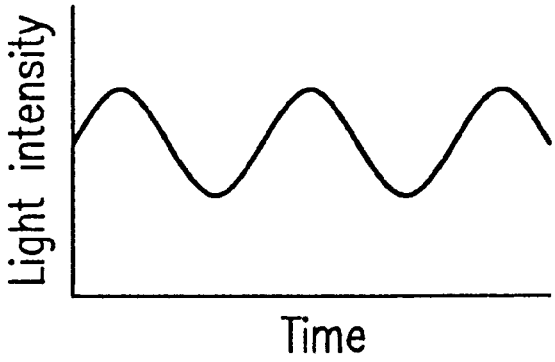
FIGS. 3A through 3C are each a schematic view illustrating an example of a time-wise change of an intensity of light provided by a sub light irradiation section.

When the intensity of the illumination light 5 smoothly varies, the observer 3 can observe the image 4 (target) without caring about the change in the illumination light 5. Accordingly, a smooth continuous change represented by a sine waveform as shown in FIG. 3A is effective. The minimum value of the intensity of the illumination light 5 is preferably kept above zero in order to allow the observer 3 to observe the image 4 without caring about the change in the illumination light 5.

Figure 3B:
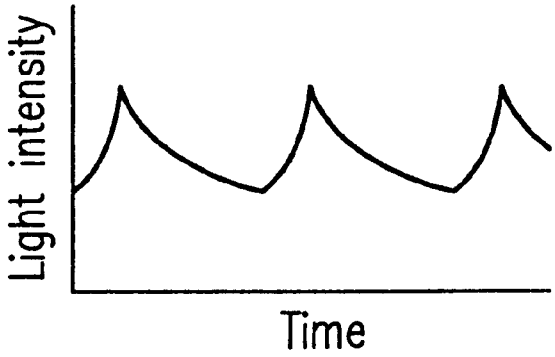
Figure 3C:
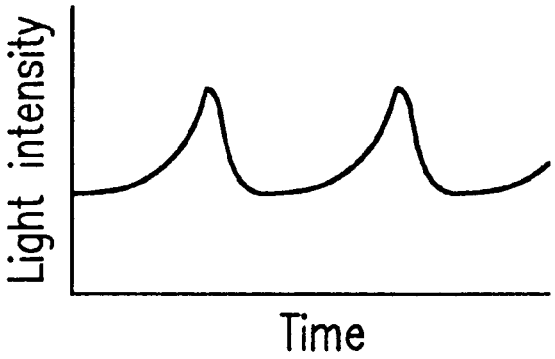

When only the effect of increasing the perceived brightness of the target is to be provided, the waveform shown in FIG. 3B is preferable. The effect of an increase in the perceived brightness is emphasized when, as shown in FIG. 3B, the rate of change is higher while the intensity of the illumination light 5 is increasing and the rate of change is lower while the intensity is decreasing. On the other hand, when only the effect of decreasing the perceived brightness of the target is to be provided, the waveform shown in FIG. 3C is preferable. The effect of a decrease in the perceived brightness is emphasized when, as shown in FIG. 3C, the rate of change is higher while the intensity of the illumination light 5 is decreasing and the rate of change is lower while the intensity is increasing.

The change in the intensity of the illumination light 5 does not need to be periodical.

In order to enhance the effect that the illumination light 5 is integrated with the illumination environment obtained from the content of the image 4, it is effective that the illumination light 5 has a similar color to that of a part of the image 4 or has a color having low chroma similar to general illumination light.

In the structure shown in FIGS. 1 and 2, the illumination source 2 (the sub irradiation section) for providing illumination light 5 (the sub illumination light) to the background or neighborhood of the image 4 which is displayed by the image display device 1 (the main irradiation section) is located immediately behind the image display device 1. The present invention is not limited to such an arrangement. For example, the illumination source 2 may be located far from the image display device 1 so that the illumination light 5 is provided from a position far from the image display device 1. In order to prevent the observer 3 from recognizing that the illumination light 5 of the illumination source 2 is provided by a light source that is not included in the illumination environment obtained from the content in the image 4, a structure in which the observer 3 cannot directly view the illumination source 2 is effective.

Figure 4:
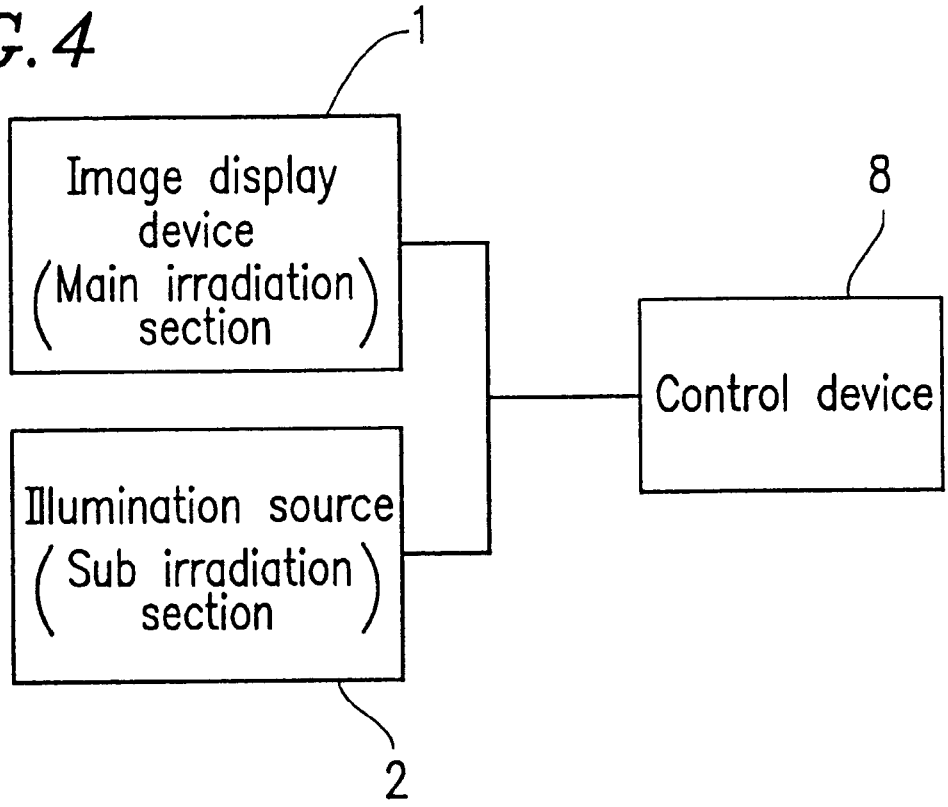
FIG. 4 is a schematic block diagram showing an exemplary image display system in the first example.

As shown in FIG. 4, the image display system can include a control device 8. When the intensity of the illumination light (the sub illumination light) provided by the illumination source 2 (the sub irradiation section) is changed in synchronization with the content of the image 4 (in FIG. 2) displayed by the image display device 1 (the main irradiation section), the observer can perceive more strongly that the illumination environment obtained by the illumination light is integrated with the illumination environment obtained from the image 4 displayed by the image display device 1. Thus, the observer feel more strongly the sense of being at the site of the image 4.

EXAMPLE 2

In a second example of the present invention, an irradiation method according to the present invention is applied to an illumination system.

Figure 5B:
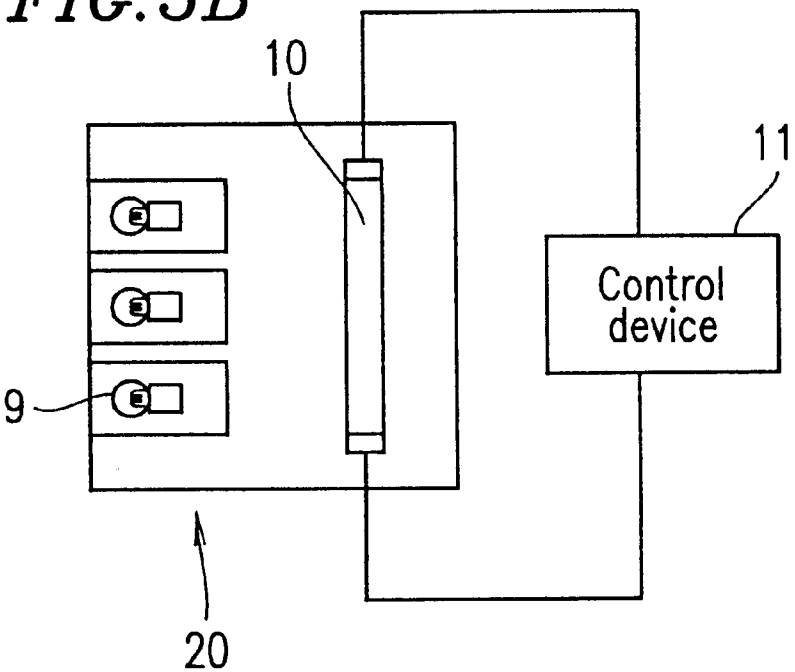
FIG. 5B is a schematic view of the illumination system including the illumination section shown in FIG. 5A.
Figure 5A:
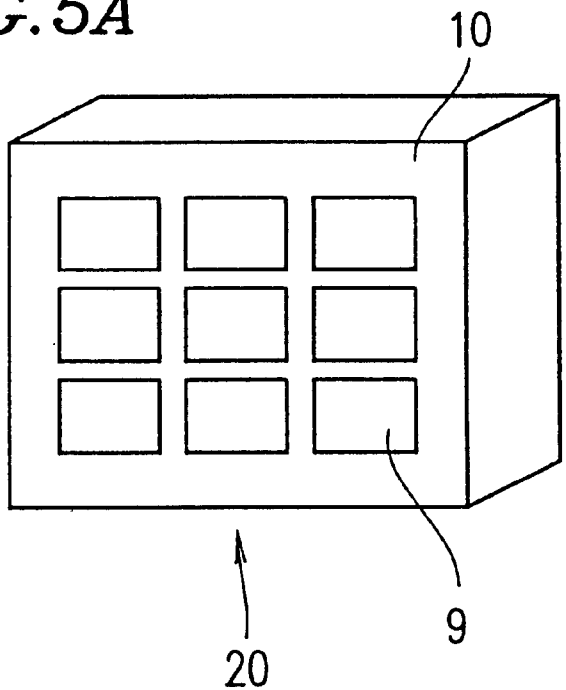
FIG. 5A is a schematic isometric view of an illumination section in an illumination system to which a light irradiation method according to the present invention is applied, as a second example of the present invention.

FIG. 5A is a schematic isometric view of an illumination section included in the illumination system to which an irradiation method according to the present invention is applied. FIG. 5B is a schematic view of the illumination system. The illumination system includes an illumination section 20 acting as an illumination source, and the illumination section 20 includes a main illumination section (the main irradiation section) 9 and a sub illumination section (the sub irradiation section) 10.

In the example shown in FIGS. 5A and 5B, the main illumination section 9 includes a compact fluorescent lamp, and the sub illumination section 10 includes a straight type 20W fluorescent lamp. More specifically, the main illumination section 9 includes nine 27W compact fluorescent lamps arranged in an array of 3×3 with a gap of two adjacent fluorescent lamps being about 1 cm. The sub illumination section 10 includes four straight type 20W fluorescent lamps arranged parallel to each other (for illustrative purposes, only one among them is shown in FIG. 5B). The illumination system further includes a control section 11 for controlling the intensity of light provided by the sub illumination section 10 (i.e., the straight type 20W fluorescent lamps).

The main illumination section 9 corresponds to a target and emits main illumination light. The sub illumination section 10 provides sub illumination light emitted from the background or neighborhood of the target.

A perceived brightness of the main illumination section 9 viewed by an observer (not shown) changes by performing time-wise control of the intensity of the sub illumination light provided by the sub illumination section 10. More specifically, when the intensity of the sub illumination light provided by the sub illumination section 10 is increased, the perceived brightness of the main illumination section 9 as the target is decreased because the contrast between the main illumination light provided by the main illumination section 9 and the sub illumination light provided by the sub illumination section 10 from the background or neighborhood is reduced. On the other hand, when the intensity of the sub illumination light provided by the sub illumination section 10 is decreased, the perceived brightness of the main illumination section 9 as the target is increased because the contrast between the main illumination light provided by the main illumination section 9 and the sub illumination light provided by the sub illumination section 10 from the background or neighborhood is raised.

According to the present invention, an efficient illumination system providing a satisfactorily bright illumination at low power consumption is realized by especially utilizing the effect of an increase in the perceived brightness of the main illumination section 9. As described above, the perceived brightness is increased when the contrast between the light from the main illumination section 9 and the light from the sub illumination section 10 is raised by reducing the intensity of the sub illumination light. Such an increase is emphasized when the intensity of the sub illumination light is changed continuously, and more specifically when, as shown in FIG. 3C, the rate of change is higher while the intensity is decreasing and the rate of change is lower while the intensity is increasing. Such a manner of adjusting the rate of change is effective for enhancing the effect of an increase in the perceived brightness of the main illumination section 9.

As described above, an illumination system to which an irradiation method according to the present invention is applied includes a main illumination section (the main irradiation section) acting as a target and emitting main illumination light and a sub illumination section (the sub irradiation section) for providing sub illumination light from the background or neighborhood of the main illumination section. By performing time-wise control of the intensity of the sub illumination light provided by the sub illumination section, the perceived brightness of the main illumination section as the target can be varied. Such a change is caused by a change in contrast between the main illumination light from the main illumination section and the sub illumination light from the sub illumination section. The perceived brightness of the main illumination section is increased by decreasing the intensity of the sub illumination section, and the perceived brightness of the main illumination section is decreased by increasing the intensity of the sub illumination section. Especially by utilizing an increase in the perceived brightness of the main illumination section, the illumination system according to the present invention obtains an improved efficiency of providing a brighter illumination at lower power consumption.

The main illumination section 9 may be any light emitting device operating based on any light emitting principle so long as the intensity of the light can be adjusted. The main illumination section 9 may include an incandescent lamp, an LED, an EL element or any other light emitting element instead of the fluorescent lamps. The sub illumination section 10 may also be any light emitting device operating based on any light emitting principle so long as the intensity of the light can be adjusted. The sub illumination section 10 may include an incandescent lamp, an LED, an EL element or any other light emitting element instead of the fluorescent lamps.

The number and the size of the light emitting elements included in the main illumination section 9 can be arbitrarily determined based on the use of the illumination system. When the main illumination section 9 includes a single light emitting element (illumination lamp) instead of a plurality of light emitting elements as shown in FIG. 5B, the contrast per unit area can be controlled more precisely and thus the effect of the present invention is more significant.

The sub illumination section 10 is provided mainly for illuminating the background or neighborhood of the main illumination section 9. The structure of the sub illumination section 10 is determined based on, for example, the number or size of the light emitting elements included in the main illumination section 9. More specifically, the size of the sub illumination section 10 is larger than that of the main illumination section 9, and the number of the light emitting elements included in the sub illumination section 10 is set so as to provide a substantially equal luminance to that of the main illumination section 9.

When the main illumination section 9 includes a plurality of light emitting elements (illumination lamps), the size of the gap between the adjacent light emitting elements is related to the contrast between the light from the main illumination section 9 and the light from the sub illumination section 10. When the gap is excessively large as compared to the size of each light emitting element included in the main illumination section 9, the area ratio of the main illumination section 9 with respect to the total size of the illumination section 20 is excessively small. Accordingly, the size of the gap is preferably set so that the contrast between the light from the main illumination section 9 and the light from the sub illumination section 10 is sufficiently perceived.

In the example shown in FIGS. 5A and 5B, the sub illumination section 10 for providing sub illumination light from the background or neighborhood of the main illumination section 9 is located immediately behind the main illumination section 9. The present invention is not limited to such an arrangement. For example, the sub illumination section 10 may be located far from the main illumination section 9 (e.g., the main illumination section 9 is located on a wall in the room and the sub illumination section 10 is located on an opposite wall), so that the sub illumination light is provided from a position far from the main illumination section 9.

The illumination system described in the second example can be used for various general uses including a system to be installed on the ceiling or the wall.

Furthermore, the present invention is more effective when being applied to an indication system in which the main irradiation section emits a prescribed indication light indicating a certain information and the observer often directly observes (or looks at) the indication light intentionally. Such an indication system can be, for example, a signal lamp, a signal lamp for passengers, or a guiding lamp.

As described above, according to the irradiation method of the present invention, a perceived brightness of a target can be effectively varied by performing time-wise control of at least one of illumination light directed toward the background or neighborhood of the target or illumination light provided from the background or neighborhood of the target (i.e., performing time-wise control of the illumination conditions in the background or neighborhood of the target) without changing the amount of light directly illuminating the target.

When such an irradiation method according to the present invention is applied to an image display system, the observer is caused to feel more strongly the sense of being at the site of the image by changing (increasing or decreasing) the perceived brightness of the image as the target.

When such an irradiation method according to the present invention is applied to an illumination system for providing an illumination light, or an indication system for emitting a prescribed indication light such as, for example, a signal lamp, the system obtains an improved efficiency of providing a brighter illumination light or a brighter indication light at lower power consumption, especially utilizing an increase in the perceived brightness of the target.

Various other modifications will be apparent to and can be readily made by those skilled In the art without departing from the scope and spirit of this invention. Accordingly, it is not intended that the scope of the claims appended hereto be limited to the description as set forth herein, but rather that the claims be broadly construed.

What is claimed is:

1. A light irradiation method using a sub irradiation section emitting sub illumination light and a main irradiation section for providing main light, the main irradiation section defining a target, wherein the sub irradiation section emits sub illumination light to or from at least one of a background and a neighborhood of the target, the method comprising the step of:

performing time-wise control of an intensity of the sub illumination light emitted by the sub irradiation section so that a perceived brightness of the target is varied.

2. A light irradiation method according to claim 1, wherein the main irradiation section is an illumination source for emitting main illumination light as the main light, and the target is the main irradiation section.

3. A light irradiation method according to claim 2, wherein a perceived brightness of the illumination source is decreased by increasing the intensity of the sub illumination light emitted by the sub irradiation section, and a perceived brightness of the illumination source is increased by decreasing the intensity of the sub illumination light emitted by the sub irradiation section.

4. A light irradiation method according to claim 2, wherein the time-wise control of the intensity of the sub illumination light is performed so that a rate of change of the intensity is lower while the intensity is increasing than while the intensity is decreasing.

5. A light irradiation method according to claim 1, wherein the main irradiation section is an indication lamp for emitting prescribed indication light as the main light, and the target is the main irradiation section.

6. A light irradiation method according to claim 5, wherein a perceived brightness of the indication lamp is decreased by increasing the intensity of the sub illumination light emitted by the sub irradiation section, and a perceived brightness of the indication lamp is increased by decreasing the intensity of the sub illumination light emitted by the sub irradiation section.

7. A light irradiation method according to claim 5, wherein the time-wise control of the intensity of the sub illumination light is performed so that a rate of change of the intensity is lower while the intensity is increasing than while the intensity is decreasing.

8. A light irradiation method according to claim 1, wherein the main irradiation section is an image display section for displaying a prescribed image, and the target is the prescribed image.

9. A light irradiation method according to claim 8, wherein a perceived brightness of the prescribed image is increased by increasing the intensity of the sub illumination light emitted by the sub irradiation section, and a perceived brightness of the prescribed image is decreased by decreasing the intensity of the sub illumination light emitted by the sub irradiation section.

10. A light irradiation method according to claim 8, wherein the prescribed image includes a content, a brightness of which is inherently changeable.

11. A light irradiation method according to claim 1, wherein a highest luminance of the sub illumination light is set to be equal to or less than a highest luminance of the target.

12. A light irradiation method according to claim 1, wherein the intensity of the sub illumination light is increased and decreased repeatedly.

13. A light irradiation method according to claim 1, wherein the intensity of the sub illumination light is varied in accordance with a sine waveform having a frequency of about 0.01 Hz or more and about 8 Hz or less.

14. A light irradiation method according to claim 1, wherein a minimum value of the intensity of the sub illumination light is larger than zero.

15. A light irradiation method according to claim 1, wherein the sub irradiation section is located at such a position that prevents an observer from viewing the sub irradiation section.

* * * * *